United States Patent [19]

Walia et al.

[11] 3,958,442

[45] May 25, 1976

[54] RATCHET TYPE HANDLE FOR CRIMPING TOOL AND THE LIKE

[75] Inventors: Gurbinder Singh Walia; Alexander Sutherland Smith, both of Brampton, Canada

[73] Assignee: Northern Electric Company Limited, Montreal, Canada

[22] Filed: Apr. 24, 1975

[21] Appl. No.: 571,361

[52] U.S. Cl. ..... 72/410; 81/177 PP; 81/177.9

[51] Int. Cl.[2] ..... B21D 9/08

[58] Field of Search ..... 72/409, 410, 391; 81/177.8, 177.9, 177 PP

[56] References Cited

UNITED STATES PATENTS

| | | | |
|---|---|---|---|
| 649,334 | 5/1900 | Meloos | 72/409 |
| 1,175,973 | 3/1916 | Miller | 81/177.9 |
| 2,086,400 | 7/1937 | Brenizer | 72/410 |
| 2,836,089 | 3/1958 | Davies | 72/410 |
| 3,396,571 | 8/1968 | Porter | 72/410 |

FOREIGN PATENTS OR APPLICATIONS

| | | | |
|---|---|---|---|
| 550,038 | 12/1942 | United Kingdom | 81/177.9 |

*Primary Examiner*—Lowell A. Larson
*Assistant Examiner*—Gene P. Crosby
*Attorney, Agent, or Firm*—John E. Mowle

[57] ABSTRACT

A unidirectional ratchet assembly is located in one arm of a crimping tool so that the tool can be actuated by relatively little movement between the ends of its two arms. The assembly includes a spring loaded pawl which can be disengaged from its associated ratchet wheel so that the crimping tool can be reset without having to spread the arms apart.

4 Claims, 3 Drawing Figures

RATCHET TYPE HANDLE FOR CRIMPING TOOL AND THE LIKE

BACKGROUND OF THE INVENTION

This invention relates to an improvement in a compression tool for crimping and the like and more particularly to one which utilizes a ratchet-like assembly disposed in one of its actuating arms so that the jaws of the tool may be opened while the two arms remain substantially closed thereby enabling the tool to be used in a relatively confined space.

Crimp-on lugs or connectors are commonly used throughout the electrical industry to terminate the ends of an electrical cable. Many of these connectors are installed utilizing a specialized tool which is adapted to crimp the connector onto the cable so as to provide a good mechanical and/or electrical bond between the two. A typical installation tool of this type is manufactured by Thomas & Betts Ltd. of Iberville Quebec, Canada, and has designated catalogue number TBM8. Such crimp-on connectors have in the past been utilized within the telephone plant to terminate both coaxial communication and power cables. However, in order to obtain the very high pressures required to crimp large connectors, the larger crimping tools utilize relatively long handles which typically measure over one meter in length when opened up. In many instances, the narrow space between aisles (nominally ⅔ meter) in the telephone plant, or the confined space of a manhole, is insufficient to permit utilization of these large crimping tools. Consequently more expensive non-crimping connectors have had to be used in these locations.

STATEMENT OF THE INVENTION

The present invention provides an improved crimping tool which utilizes a unidirectional clutch or ratchet-type assembly in one arm of the tool so that it may be employed in a relatively confined space without sacrificing the necessary leverage provided by the longer handles.

Thus, the present invention is directed to an improvement in a tool having a pair of pivotally arms or handles coupled to each other for actuating a pair of jaws and the like, in which one of the arms is divided into a shorter central segment and a longer end segment connected by a pivotable joint. The axes of the pivotally coupled arms and pivotable joint are parallel to each other. The pivotable joint includes a unidirectional clutch or ratchet assembly which allows the free end segment of the arm to swing in only one direction. In addition, a means is provided for disengaging the clutch or ratchet to enable relative movement of the pair of jaws while the free ends of the two arms remain substantially closed.

In a particular embodiment of the invention the central segment is considerably shorter than the end segment and the clutch assembly utilizes a unidirectional ratchet which is coaxially disposed about the pivotable joint. The end segment has a spring-loaded pawl which is urged into engagement with the ratchet so as to allow the free end of the arm to only swing open without relative movement of the central segment with respect to the other arm. The end segment also has a hand-actuated means for disengaging the pawl from the ratchet to enable the pair of jaws to be opened while the free ends of the arms remain relatively closed.

This hand-actuated means may comprise a sleeve which is disposed about a portion of the end segment. The sleeve includes a pin which passes through a slot in the pawl so that longitudinal axial movement of the sleeve down the arm causes the pin to engage the pawl and pull it out of engagement with the ratchet.

BRIEF DESCRIPTION OF THE DRAWINGS

An example embodiment of the invention will now be described with reference to the accompanying drawings in which.

DESCRIPTION OF THE PREFERRED EMBODIMENT

Figure 1:
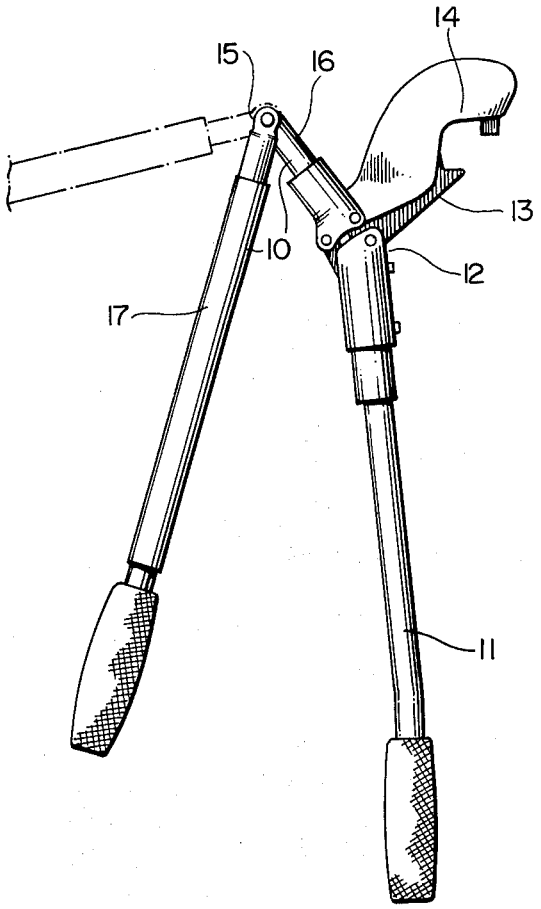
FIG. 1 is a plan view of a crimping tool incorporating a ratchet assembly in one of its arms.

Referring to FIG. 1 the crimping tool basically comprises a pair of arms or handles 10 and 11 connected to a pivot assembly 12 to actuate a pair of crimping jaws 13 and 14 upon closure of the arms 10 and 11 in a well known manner. The improvement in the crimping tool is the addition of a unidirectional clutch or ratchet assembly 15 in one of the arms 10 which allows the utilization of relatively long handles on the crimping tool without sacrificing the leverage required to utilize the tool in a relatively confined space.

Figure 2:
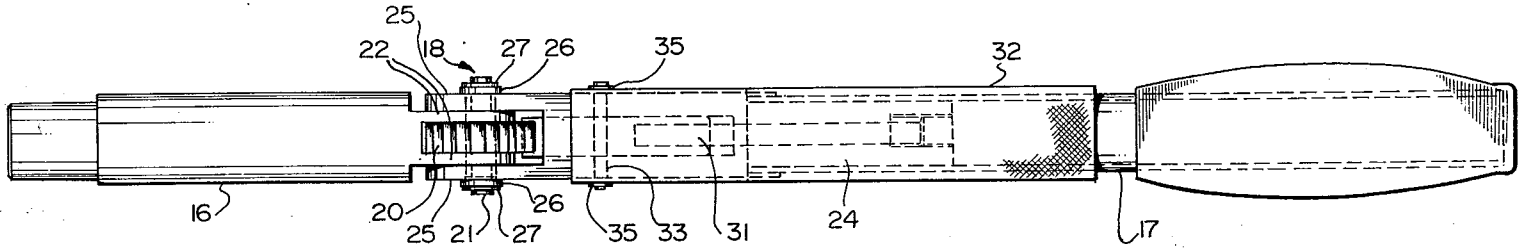
FIG. 2 is an enlarged view of the arm shown in FIG. 1, illustrating in greater detail the ratchet assembly.
Figure 3:
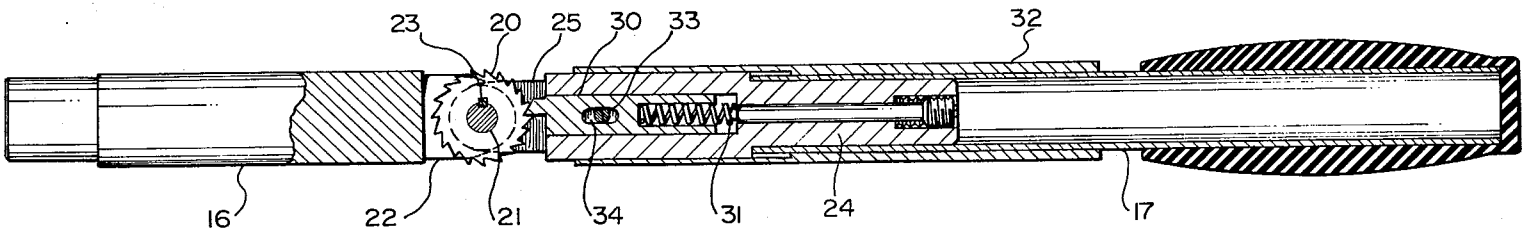
FIG. 3 is an alternate view of the arm, rotated 90° with respect to that illustrated in FIG. 2.

Referring also to FIGS. 2 and 3, the arm 10 includes a shorter central segment 16 which in the assembled tool is adjacent the pivot assembly 12; and a longer end segment 17 both connected at a pivotable joint, generally 18.

In greater detail, the pivotable joint 18 includes a unidirectional ratchet wheel 20 coaxially located on an axial pin 21 and rigidly coupled to a pair of flanges 22, protruding from the end of the central segment 16, via a key 23 disposed between the two on the pin 21. The end segment 17 has an inset portion 24 which includes a pair of flanges 25 that are rotatably mounted on the pin 21 and contained by a pair of washers 26 and C-clips 27 in a well known manner.

The longer end segment 17 also has a spring-loaded pawl 30 which is urged into engagement with the unidirectional ratchet wheel 20 along the longitudinal axis of the arm 10 by helical spring 31. In addition, a sleeve 32 disposed about a portion of the end segment 17, includes a pin 33 which passes through a slot 34 in the pawl 30 so that longitudinal axial movement of the sleeve (to the right) along the end segment 17 causes the pin 33 to engage the pawl 30 and pull the latter out of engagement with the ratchet wheel 20. The pin 33 is also held by C-clips 35. The arm 10 is mounted on the crimping tool so that its free end 17 can normally only swing open with respect to the arm 11 without relative movement of the central segment 16 with respect to the other arm 11.

During operation, the crimping tool is first placed over a crimp-on connector (not shown) with the jaws 13 and 14 wide open. The tool is then actuated by repeatedly opening and closing the ends of the arms 10 and 11 a sufficient distance for the pawl 30 to engage the next tooth in the ratchet wheel 20 to draw the jaws 13 and 14 together so as to compress the connector in a well known manner.

Once the crimping action has been completed, it is then necessary to reset the crimping tool by opening the crimping jaws 13 and 14 to their widest position. Assuming that the crimping tool is positioned with its crimping jaws 13 and 14 facing upwards, this is readily achieved by grasping the arm 11 in one hand and pulling down on the sleeve 32 with the other hand until the pawl 30 is disengaged from the ratchet wheel 20. Thereupon, the other hand simultaneously grasps both the sleeve 32 and the outer end of the end segment 17 and with an upward motion of the arm 10 causes the central segment 16 to rotate the pivot assembly 12 to open the crimping jaws 13 and 14. The crimping tool is then ready to apply the next crimp-on connector. It will be observed that during the entire operation of the crimping tool the free ends of the arms 10 and 11 remain in a relatively closed position with the maximum space between them being approximately the same as or less than the length of the shorter central segment 16 of the arm 10. As a result, the crimping tool can be used in a relatively confined space without sacrificing the leverage necessary to provide the extreme pressures required to operate the tool.

While the operation of the crimping tool has been described with inward pressure being applied to close the jaws 13 and 14 of the tool, in alternate embodiments, the operation could be reversed simply by rotating the arm 10 by 180° about its longitudinal axis particularly when incorporated in other types of tools. In addition, the location of the ratchet wheel 20 and the pawl 30 could be reversed with respect to the shorter central segment 16 and the longer end segment 17. However, this may considerably complicate the resetting of the jaws 13 and 14 during operation of the crimping tool.

What is claimed is:

1. In a tool having a pair of arms pivotally coupled to each other to actuate a pair of jaws for crimping and the like:

the improvement comprising:

one of the arms having a shorter central segment and a longer end segment connected at a pivotable joint;

one of the segments having a ratchet coaxially disposed about said pivotable joint;

the other segment having a pawl which coacts with the ratchet so as to allow the free end of the arm to only swing open without relative movement of the central segment of said one arm with respect to the other arm;

said other segment having means for disengaging the pawl from the ratchet to enable the pair of jaws to be opened while the free ends of the two arms remain substantially closed and;

the axes of the pivotally coupled arms and the pivotable joint being parallel to each other.

2. In a tool having a pair of arms pivotally coupled to each other for actuating a pair of jaws and the like:

the improvement comprising:

one of said arms having a shorter central segment and a longer end segment connected by a pivotable joint;

the pivotable joint including a unidirectional clutch which allows the end segment of the arm to swing in only one direction;

means for disengaging the clutch to enable relative movement of the pairs of jaws while the free ends of the two arms remain substantially closed and;

the axes of the pivotally coupled arms and the pivotable joint being parallel to each other.

3. In a tool having a pair of arms pivotally coupled to each other to actuate a pair of jaws for crimping and the like:

the improvement comprising:

one of said arms having a shorter central segment and a longer end segment connected at a pivotable joint;

the central segment having a unidirectional ratchet coaxially disposed about said pivotable joint;

the end segment having a spring-loaded pawl which is urged into engagement with the ratchet so as to allow the free end of the arm to only swing open without relative movement of the central segment with respect to the other arm;

the end segment also having hand actuated means for disengaging the pawl from the ratchet to enable the pair of jaws to be opened while the free ends of the two arms remain substantially closed and;

the axes of the pivotally coupled arms and the pivotable joint being parallel to each other.

4. A tool as defined in claim 3 in which the pawl is urged by its spring along the longitudinal axis of the end segment into engagement with the ratchet; and in which the hand actuated means comprises:

a sleeve disposed about a portion of said end segment, the sleeve including a pin which passes through a slot in the pawl, so that longitudinal axial movement of the sleeve along the arm causes the pin to engage the pawl and pull it out of engagement with the ratchet.

* * * * *